United States Patent [19]

Mielke

[11] 3,978,932

[45] Sept. 7, 1976

[54] APPARATUS AND METHOD FOR OBTAINING UNDISTURBED SOIL CORE SAMPLES

[75] Inventor: Lloyd N. Mielke, Lincoln, Nebr.

[73] Assignee: The United States of America as represented by the Secretary of Agriculture, Washington, D.C.

[22] Filed: Jan. 28, 1975

[21] Appl. No.: 544,995

Related U.S. Application Data

[62] Division of Ser. No. 465,650, April 30, 1974, Pat. No. 3,872,935.

[52] U.S. Cl. ..... 175/249; 175/243; 175/405

[51] Int. Cl.[2] ..... E21B 9/20

[58] Field of Search ..... 175/58, 59, 19, 20, 175/77, 239, 243, 249, 251, 253, 405

[56] References Cited

UNITED STATES PATENTS

| | | | |
|---|---|---|---|
| 2,779,195 | 1/1957 | Simon | 175/59 X |
| 2,807,439 | 9/1957 | Lipscomb | 175/239 X |
| 3,008,529 | 11/1961 | Lynch et al. | 175/243 |
| 3,180,438 | 4/1965 | Dickinson et al. | 175/239 |
| 3,383,131 | 5/1968 | Rosfelder | 175/243 X |
| 3,525,409 | 8/1970 | Holzman | 175/243 X |
| 3,807,234 | 4/1974 | Duperon | 175/249 X |
| 3,833,075 | 9/1974 | Bachman et al. | 175/20 |

*Primary Examiner*—Ernest R. Purser
*Assistant Examiner*—Richard E. Favreau
*Attorney, Agent, or Firm*—M. Howard Silverstein; David G. McConnell

[57] ABSTRACT

Large-diameter, undisturbed soil core samples were obtained from a variety of soils. Handling and fracturing of the undisturbed soil cores were minimized by encasing the cores in heat-shrinkable plastic tubes during sampling operations.

3 Claims, 5 Drawing Figures

APPARATUS AND METHOD FOR OBTAINING UNDISTURBED SOIL CORE SAMPLES

This is a division of application Ser. No. 465,650, filed Apr. 30, 1974, now Pat. No. 3,872,935.

BACKGROUND OF THE INVENTION

This invention relates to an apparatus for obtaining undisturbed soil cores. Soil cores with undisturbed structure are desirable to measure physical and chemical properties, particularly water content and nutrient movement.

Undisturbed soil sampling techniques using hand-driven equipment were reported by Lutz, Soil Sci. 64: 399–401, 1947; and Veihmeyer, Soil Sci. 27: 147–152, 1929. The machine built by Kelley et al., Soil Sci. Soc. Amer. Proc. 12: 85–87, 1947, could take undisturbed soil cores of 5- and 10-cm. (2- and 4-in.) diameters and up to 1.8 m. (6 ft.) long. An earlier machine reported by Kelley and Haise, J. Amer. Soc. Agron. 39: 828–830, 1947, had similar sampling capabilities but required a considerable amount of manual labor. Hydraulic and electric units developed to increase sampling speed have been developed by Jensen et al., Trans. Amer. Soc. Agr. Eng. 3(1): 22–24, 1960; and Buchele, Trans. Amer. Soc. Agr. Eng. 4(2): 185–187, 1961.

Kelley et al. (supra) reported using a split-sheet metal container to protect the soil sample from fracture during transport to the laboratory. Care in sample handling and processing is required for all undisturbed samples. Split-tube-type samplers require that the sample be removed, trimmed, and coated with a casing material. Adsorption of paint-on, or dip-type coating materials, may affect the effective cross-section of the core and provide little mechanical support. Rigid wall sample containers may permit undetected water flow paths which would affect results and conclusions.

Bondurant et al., Soil Sci. 107: 70–71, 1969, used heat-shrinkable tubing (polyolefin) to encase undisturbed soil cores. The space between the soil core and the outer barrier was effectively sealed on soil cores 240 mm. long and 82 mm. diameter.

In accordance with the invention, I have discovered, in an apparatus for collecting undisturbed soil core samples of the type comprising a cylindrical tube or sample body, open at both ends, and having at one end thereof a cutting tip which is sharpened to facilitate entry into the ground, an improvement comprising a tubular lining of flexible heat-shrinkable plastic open at both ends, contained within said sampler body, and having an outside diameter which is essentially equal to the inside diameter of said sampler body; and a means for securely holding said tubular lining in place.

This heat-shrinkable, plastic-lined soil core sampler is then pressed into the ground, removed from the ground, and the plastic lining heated to a temperature sufficient to cause shrinkage of the plastic to the soil.

The drawings consist of a perspective view and two section views of the sampler body, and two perspective views of retaining rings.

DETAILED DESCRIPTION OF THE INVENTION

Many commercially available soil core samplers could be easily modified for use in accordance with the invention. Preferably, the sampler is a thin-walled metal tube with a sharpened cutting tip at one end. Its size is dependent on the type of soil being sampled.

Figure 1:
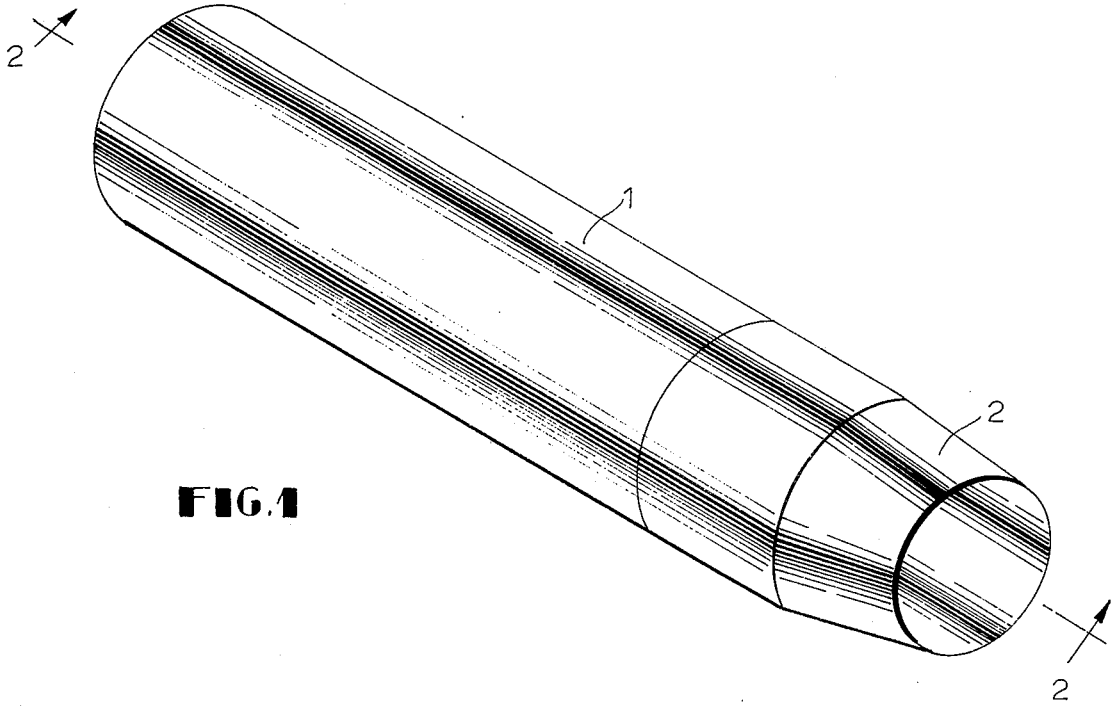
Figure 2:
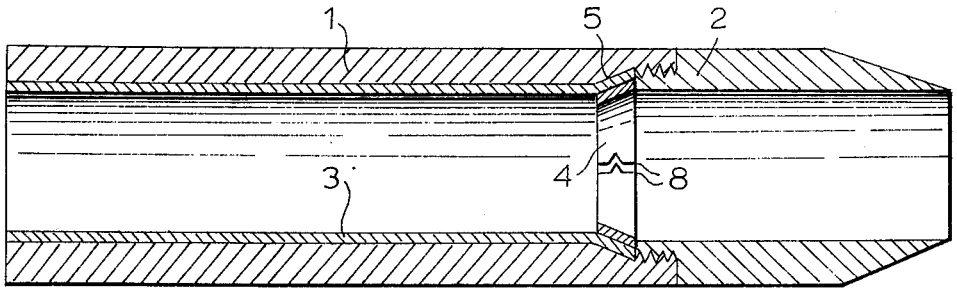
Figure 3:
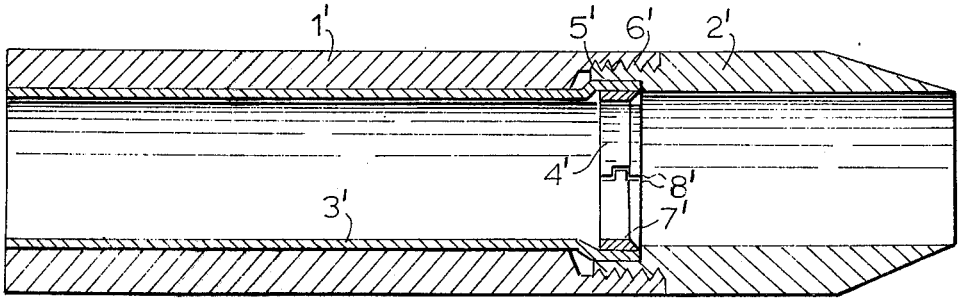

Preferably, the entire soil core sampler (i.e., body plus tip) is up to 4 ft. long and up to about 4 in. in inside diameter. It can be a single piece or it can have a removable cutting head. FIG. 1 is a perspective view of a two-piece sampler tube with sampler body 1 connected to cutting tip 2 which is beveled to give it the desired sharpness. FIG. 2 is a section view of the soil core sampler ready for use, taken along section line 2—2 of FIG. 1 showing a heat-shrinkable plastic lining 3 and a compressible, resiliant retaining ring 4 in place. Retaining ring 4 is positioned in an annular groove 5 in the inner wall of sampler body 1. FIG. 3 shows the same section view as FIG. 2 with the exception that annular groove 5' is internal of threaded section 6' on sampler body 2'. Having threads in the annular groove (5) in the embodiment of FIG. 2 provides a gripping surface for the heat-shrinkable plastic lining. It is preferred that this or some other type of gripping surface be provided.

Figure 4:
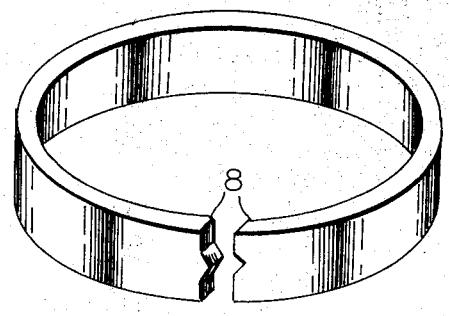
Figure 5:
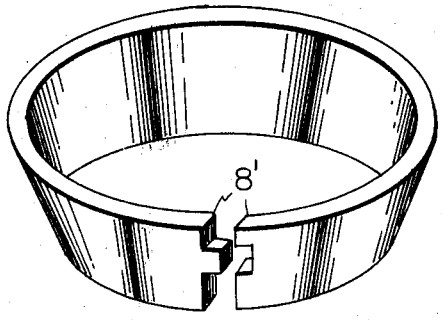

The heat-shrinkable plastic lining can be securely held in place by any suitable means, but it is preferably held in place by a compressible, resiliant retaining ring such as that shown as 4 and 4' in section in FIGS. 2 and 3 and in perspective in FIGS. 4 and 5. The preferred compressible, resiliant retaining ring is beveled on the leading inside edge 7' as shown in FIG. 3. This bevel prevents undercutting the soil core as it passes through the retaining ring. However, an unbeveled retaining ring is within the scope of the invention, FIG. 4. It is also preferred that the compressible, resiliant retaining ring be split to facilitate compression of the ring in order to fit it into annular groove 5' in the inner wall of the sampler body, and that the retaining ring ends 8' in FIGS. 2, 3, 4, and 5 be notched in such a manner that when the ring is in place in annular groove 5' the ends will maintain alignment with respect to each other. The compressible resiliant retaining ring 4' and annular groove 5' must have dimensions such that, when the heat-shrinkable plastic lining 3' and the compressible, resiliant retaining ring 4' are in place, the lining will be held with sufficient security to withstand the forces of friction of the soil core when pushing the soil core sampler into the ground. This was accomplished in one embodiment of the invention, as shown in the figures, by using a retaining ring 4 such that, when the retaining ring is compressed, its outside diameter is essentially the same as the diameter of the annular groove 5. When the outside diameter of the compressed retaining ring and the diameter of the annular groove are said to be essentially the same, it is herein understood that the diameter of the annular groove is sufficiently larger than the outside diameter of the compressed retaining ring to allow the retaining ring to be put in place with the heat-shrinkable plastic lining in between the retaining ring and the surface of the annular groove (cf. FIGS. 2 and 3). The edges of the retaining ring may be of different dimensions so that the outer surface of the ring is beveled as shown in FIG. 5. In this instance annular groove 5 should be beveled in the same manner as the ring as shown in FIG. 2.

Compressible, resiliant retaining rings suitable for use in the invention may be of any material that is rigid, and has sufficient "spring" to hold itself and the heat-shrinkable plastic lining in place. In the embodiment shown in FIGS. 2 and 3 removable cutting tips 2' is screwed into sampler body 1' forcing the tip against retaining rings 4' in such a way that the ring is held tightly in place. However, a retaining ring could be used that has enough force to its "spring" that the heat-shrinkable plastic lining would be held securely in an annular groove that was positioned by itself in the inner wall of the sampler body. In this embodiment a one-piece sampler body and cutting tip could be used. Methods of securing a removable cutting tip to the sampler body other than threads could be used, such as a bayonet-type mounting.

Commercially available heat-shrinkable plastic tubing have various compositions including tetrafluoroethylene resins (TFE or FTE), polyolefins, and irradiated polyvinyl chloride (PVC). These products are available in continuous rolls and 4-ft. lengths with diameters of up to 8 in. and in various colors or clear plastic. The tubing remains flexible after being heat-shrunk and does not soften, when heated, to the point where soil particles might become embedded. Clear, heat-shrinkable plastic tubing is preferred to permit observation of wetting fronts and other conditions such as growth of microorganisms during the measurement of physical and chemical properties of the soil. Shrinking of the plastic is accomplished by subjecting it to tempertures of about 135°C. For optimum results the heat should be applied as evenly as possible over the surface of the encased core. Sufficient heat can be applied to the encased core while in the soil core sampler, or the encased core can be removed from the sampler before heating.

In use, the soil core sampler with the heat-shrinkable plastic lining securely in place is pushed into the ground to the desired depth by hydraulic pressure or similar means. Preferably, the sampler is forced into the soil at a constant rate without stopping until the desired depth is reached. The sampler is then pulled out of the ground, and the heat-shrinkable plastic is heated, encasing the soil sample. Means for forcing the sampler into the ground and removing it from the ground are well known in the prior art.

The following example is to further describe the invention and should not be construed as limiting the scope of the invention as defined by the claims.

EXAMPLE 1

White heat-shrinkable FTE tubing 4 in. in diameter and 4 ft. long was shaped to the inside contours of a 4-in. inside diameter, 4-ft. overall length soil core sampler having a threadmounted, removable cutting tip as shown in FIG. 3. A 16-gauge, compressible, resiliant retaining ring of the type shown in FIG. 4 was compressed to its smallest diameter and slipped into place on one end of the heat-shrinkable plastic lining at the edge of the sampler body threads which hold the cutting tip. The cutting tip was then screwed on, forcing the retaining ring against the inner surface of the sampler body (see FIG. 3).

The heat-shrinkable, plastic-lined soil core sampler described above was forced into the ground of a beef cattle feedlot with a Gidding, truck-mounted hydraulic probe, model GSRP-ST equipped with a Kelly bar (driven bar). The sampler was forced into the soil at a constant rate without stopping until a depth of about 4 ft. was reached. The soil core sampler was retracted from the soil, the cutting tip unscrewed, and the retaining ring removed. The soil core encased in heat-shrinkable plastic was removed from the sampler and supported on a flat surface. End plugs about the same size as the sample core were placed in each end of the plastic tube to help shape and protect the soil core when the heat-shrinkable plastic is heated and shrunk. Heat was uniformly applied to the plastic from a portable blower having a 400° to 538°C. heat output and a 0.25 $m^3$ per minute air output until the shrinkage was uniform.

Six undisturbed cores from 20 to 35 in. long were successfully removed from feedlots underlain with sandy and silty-loam soil, and one undisturbed core 37 in. long was successfully removed from a cropped cornfield.

The undisturbed soil cores were used with gamma ray attenuation techniques as a nondestructive method of investigating water movement under beef cattle feedlots. Initial observations indicated that water movement into feedlot surfaces is very slow. Water applied to the surface of one undisturbed core showed no further infiltration over a 21-da. period following initial adsorption by the relatively dry organic matter. While this represents an extreme soil and water condition, it shows that an effective seal exists between the soil column and the heat-shrinkable tube.

I claim:

1. In an apparatus for collecting undisturbed soil core samples of the type comprising a cylindrical tube or sampler body, open at both ends, and having at one end thereof a cutting tip which is sharpened for facilitating entry into the ground, an improvement comprising a tubular lining of flexible heat-shrinkable plastic open at both ends, contained within said sampler body, and having an outside diameter which is essentially equal to the inside diameter of said sampler body, said sampler body having an annular groove on the inner wall positioned near the cutting tip end; and a compressible, resiliant retaining ring positioned in said annular groove and having a compressed outside diameter the same as the diameter of said annular groove for holding said tubular lining in place.

2. An apparatus as described in claim 1 wherein the compressible, resiliant retaining ring is a split ring, with ends which have a means for maintaining alignment with respect to each other when said split ring is compressed.

3. An apparatus as described in claim 1 wherein at least one inside edge of said retaining ring is beveled to avoid undercutting the soil core during use.

* * * * *